US006928666B1

(12) United States Patent
Schaffer

(10) Patent No.: US 6,928,666 B1
(45) Date of Patent: Aug. 16, 2005

(54) TOILET WITH SELF-CONTAINED VENTILATION SYSTEM

(76) Inventor: Richard C. Schaffer, 3920 W. Vickery, Fort Worth, TX (US) 76107

( * ) Notice: Subject to any disclaimer, the term of this patent is extended or adjusted under 35 U.S.C. 154(b) by 0 days.

(21) Appl. No.: 10/918,972

(22) Filed: Aug. 16, 2004

Related U.S. Application Data

(63) Continuation-in-part of application No. 10/791,919, filed on Mar. 3, 2004, now abandoned.

(51) Int. Cl.[7] ..... E63D 9/04
(52) U.S. Cl. ..... 4/213; 4/349; 4/350; 4/216; 4/219
(58) Field of Search ..... 4/347–352, 209 R–219, 4/378, 417–419, 324, 326; 137/360; 285/317

(56) References Cited

U.S. PATENT DOCUMENTS

| | | | |
|---|---|---|---|
| 1,520,553 | A | 12/1924 | Alexander |
| 2,443,705 | A | 6/1948 | Fitzgerald |
| 2,575,778 | A | 11/1951 | Wilson |
| 2,985,890 | A | 5/1961 | Baither |
| 3,192,539 | A | 7/1965 | Martz |
| 3,568,216 | A | 3/1971 | Valdespino |
| 3,902,203 | A | 9/1975 | Poister et al. |
| 4,103,370 | A | 8/1978 | Arnold |
| 4,864,664 | A | 9/1989 | Higgins |
| 4,933,996 | A | 6/1990 | Sowards |
| 5,005,222 | A | 4/1991 | Sim |
| 5,042,096 | A | 8/1991 | Bolli |
| 5,054,131 | A | 10/1991 | Sim |
| 5,201,079 | A | 4/1993 | Sowards |
| 5,283,913 | A | 2/1994 | Jaeckels |
| 5,361,422 | A | 11/1994 | Vincent et al. |
| 5,386,594 | A | 2/1995 | Hilton |
| 5,491,847 | A | 2/1996 | Shaffer |
| 5,522,093 | A | 6/1996 | Schaffer |
| 5,692,249 | A | 12/1997 | Johnson |
| 5,715,543 | A | 2/1998 | Sim |
| 5,875,496 | A | 3/1999 | Schaffer |
| 5,898,951 | A | 5/1999 | Rakoz |
| 5,983,413 | A | 11/1999 | Hayashi et al. |

(Continued)

FOREIGN PATENT DOCUMENTS

| | | |
|---|---|---|
| EP | 1 235 038 | 8/2002 |
| JP | 4-111821 | 4/1992 |

OTHER PUBLICATIONS

Cecil Adams, The Straight Dope, 2 pages, Apr. 16, 1999, www.straightdope.com.classics/a990416.html.

(Continued)

*Primary Examiner*—Khoa D. Huynh
(74) *Attorney, Agent, or Firm*—Geoffrey A. Mantooth

(57) ABSTRACT

A ventilation system is self contained on a toilet. The ventilation system has an enlarged vent pipe located in the water tank that communicates with the upper rim ducts of the toilet bowl. The vent pipe extends out of the water tank and reenters the toilet via the drain channel at a location downstream of the water trap. The vent pipe has a float valve in the water tank to prevent the tank from overflowing. A fan in the vent pipe exhausts the air from the toilet bowl; a flapper valve on the vent pipe end acts as a one-way valve preventing the flush from entering the exhaust duct.

5 Claims, 5 Drawing Sheets

U.S. PATENT DOCUMENTS

| | | | |
|---|---|---|---|
| 5,991,933 | A | 11/1999 | Schaffer |
| 6,073,275 | A | 6/2000 | Klopocinski |
| 6,173,453 | B1 | 1/2001 | Shahar |
| 2003/0229937 | A1 | 12/2003 | Curtis et al. |

OTHER PUBLICATIONS

Sarah Tan, Think before you flush or brush, 3 pages, 2002, serendip.brynmawr.edu/biology/b103/f02/web2/stan.html.
Mary Roach, How To Win At Germ Warfare, pp. 77-80, Jul./Aug. 1994, Health.

TOILET WITH SELF-CONTAINED VENTILATION SYSTEM

This application is a continuation-in-part application of Ser. No. 10/791,919, filed Mar. 3, 2004 now abondoned.

FIELD OF THE INVENTION

The present invention relates to toilets and apparatuses for ventilating toilet bowls.

BACKGROUND OF THE INVENTION

Restrooms containing toilets are difficult to keep sanitary. This is true whether the restrooms are public or private.

When a human sits on a toilet, various gases may be emitted from the human. In addition, many now believe that the flushing of the toilet produces aerosols containing pathogens. These gases and aerosols permeate the restroom, contaminating surfaces, such as water valve handles at a sink, and objects, such as toothbrushes and towels, with germs.

I have developed a number of toilet ventilation systems, which systems exhaust the air from the toilet bowl out of the restroom. I have obtained the following U.S. Pat. Nos. 5,991,933; 5,875,496; 5,522,093 and 5,491,847. These systems ventilate the toilet bowl by drawing in the air from the bowl and out to a pipe in a wall of the restroom. These types of systems, while working quite well in ventilation, are expensive to install because a vent pipe must be installed in the restroom wall, with the pipe either exiting the building through the roof or tying into another vent pipe.

SUMMARY OF THE INVENTION

It is an object of the present invention to provide a toilet ventilation system that is self contained.

It is another object of the present invention to provide a toilet ventilation system that is easy to install.

The present invention provides a toilet that comprises a bowl having a drain channel that extends from the bowl. The bowl and the drain channel have a water trap. The bowl has an upper rim. The upper rim has an upper rim duct that communicates with the bowl by plural openings. A water tank is located above the bowl. The tank has an aperture that is in communication with the upper rim duct. A base member is located in the water tank and covers the aperture. The base member comprises a flapper valve passage and a vent pipe passage. The flapper valve passage normally is covered by a flapper valve that when opened, permits flushing of the bowl through the aperture, the upper rim ducts and the opening. A vent pipe extends from and communicates with the vent pipe passage of the base member, out of the water tank to a location of the drain channel downstream of the water trap. A fan is located in-line with the vent pipe. The upper rim duct is the only channel for conveying water from the water tank to the bowl. Some of the openings in the upper rim duct are larger than the other openings.

In accordance with one aspect of the present invention, the larger openings are located at a front portion of the bowl, with the water tank adjacent a rear portion of the bowl.

In accordance with still another aspect of the present invention, the larger openings are at least 15 times larger than the other openings.

In accordance with another aspect of the present invention, the diameter of the vent pipe passage in the base member is at least 70% of the diameter of the aperture and the diameter of the flapper valve passage in the base member is at least 70% of the diameter of the aperture.

In accordance with another aspect of the present invention, the vent pipe inside diameter is as large as the inside diameter of the vent passage in the base member.

In accordance with still another aspect of the present invention, there is a one-way valve in the vent pipe so as to prevent gases from downstream of the water trap from entering the bowl by way of the vent pipe.

In accordance with another aspect of the present invention, the one-way valve is a flapper valve located in the drain channel.

In accordance with another aspect of the present invention, the one-way valve is removable for cleaning.

The present invention also provides a toilet comprising a bowl having a drain channel that extends from the bowl. The bowl and the drain channel have a water trap. The bowl has an upper rim. The upper rim has an upper rim duct that communicates with the bowl by plural openings. A water tank is located above the bowl. The tank has an aperture that is in communication with the upper rim duct. A base member is located in the water tank and covers the aperture. The base member comprises a flapper valve passage and a vent pipe passage. The flapper valve passage normally is covered by a flapper valve that when opened, permits flushing of the bowl through the aperture, the upper rim ducts and the opening. A vent pipe extends from and communicates with the vent pipe passage of the base member, out of the water tank to a location of the drain channel downstream of the water trap. A fan is located in-line with the vent pipe. There is a one-way valve located in the vent pipe so as to prevent gases from downstream in the water trap from entering the bowl by way of the vent pipe. The one-way valve is located in the drain channel and is removable therefrom for cleaning.

DESCRIPTION OF THE PREFERRED EMBODIMENT

Figures 1, 1A:
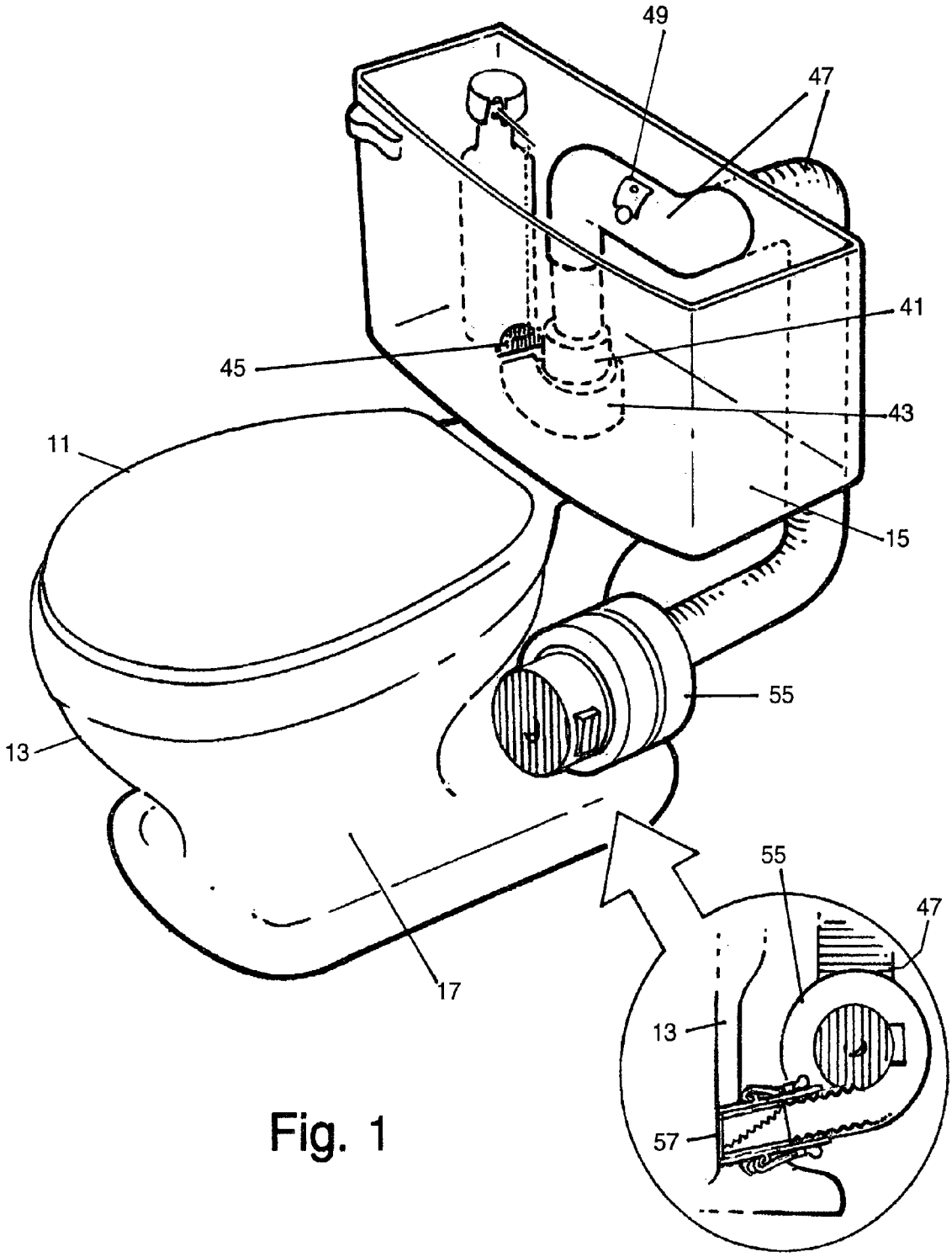
FIG. 1 is an isometric view of a toilet, equipped with the ventilation system of the present invention, in accordance with a preferred embodiment shown with the tank partially cut away.
FIG. 1A is a cross-sectional view of the connection of the vent pipe with the toilet.
Figure 3:
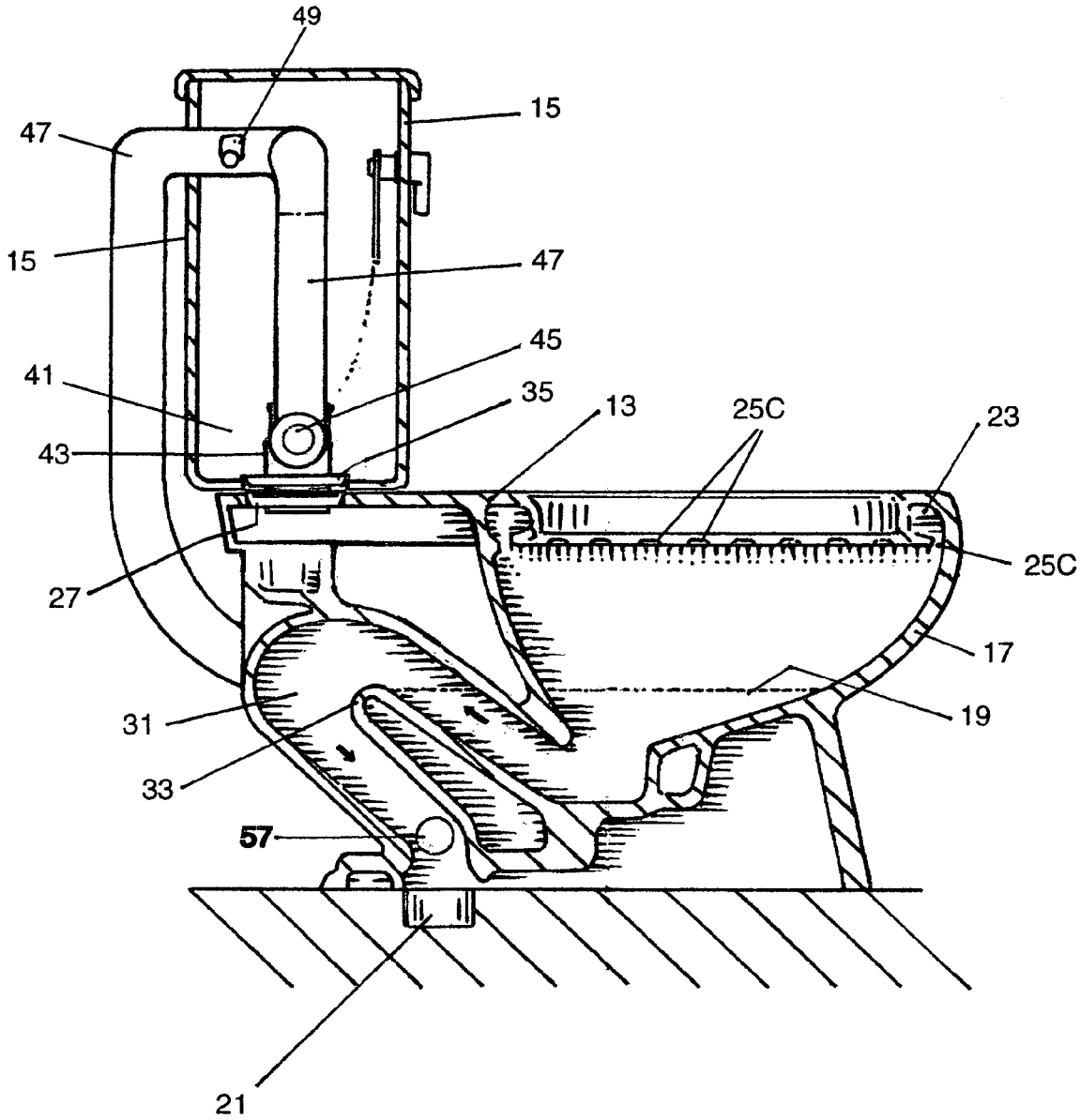
FIG. 3 is a cross-sectional view of the toilet of FIG. 1.
Figure 4:
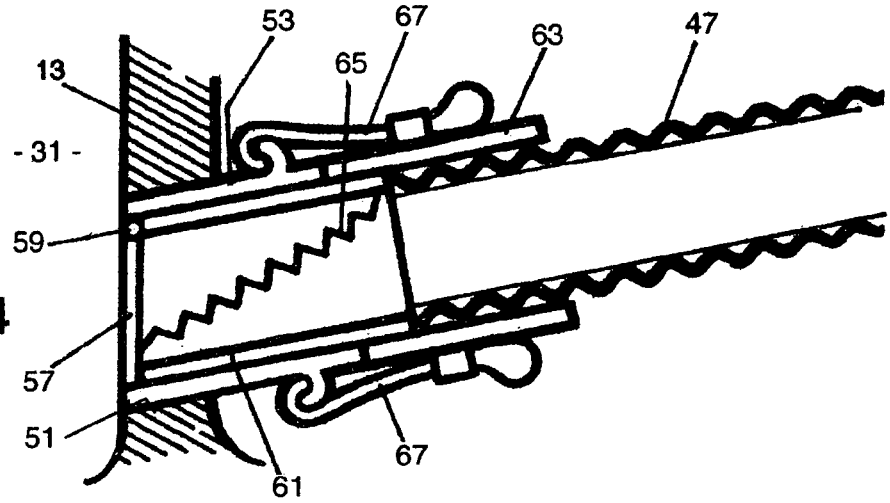
FIG. 4 is a cross-sectional view of the vent pipe fitting in the toilet, shown with the vent pipe assembled onto the fitting.
Figure 5:
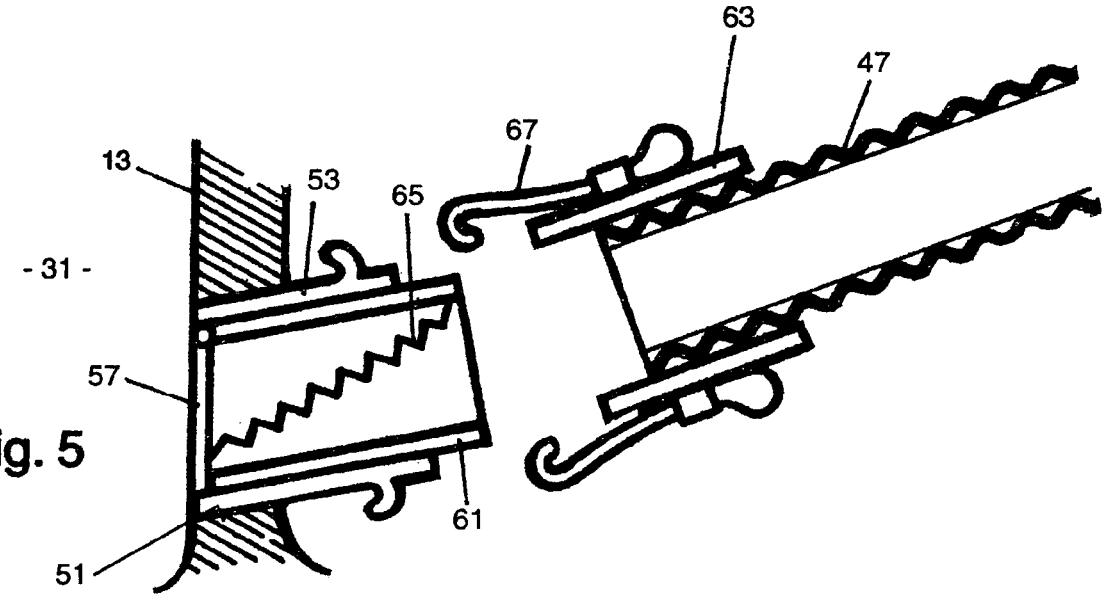
FIG. 5 is a cross-sectional view of the vent pipe fitting in the toilet, shown with the vent pipe disassembled from the fitting.
Figure 6:
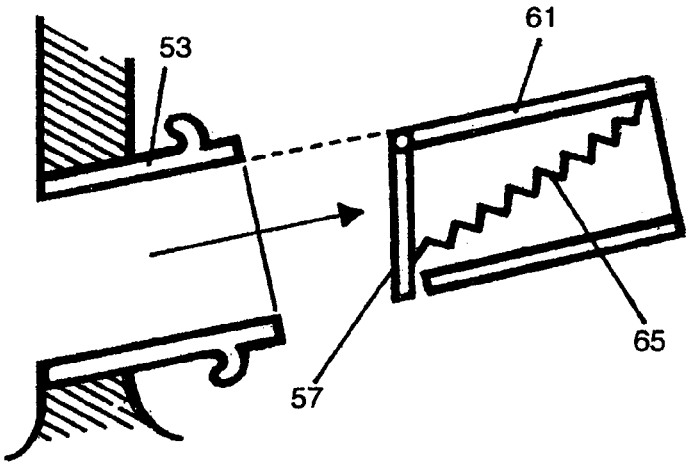
FIG. 6 is a cross-sectional view of the flapper valve portion of the vent pipe removed from the drain channel.

FIGS. 1 and 3 show a toilet 11 with a bottom portion 13 and a water tank 15. The toilet 11 is more fully described in my earlier U.S. Pat. No. 5,991,933, the disclosure of which is incorporated herein by reference.

Figure 2:
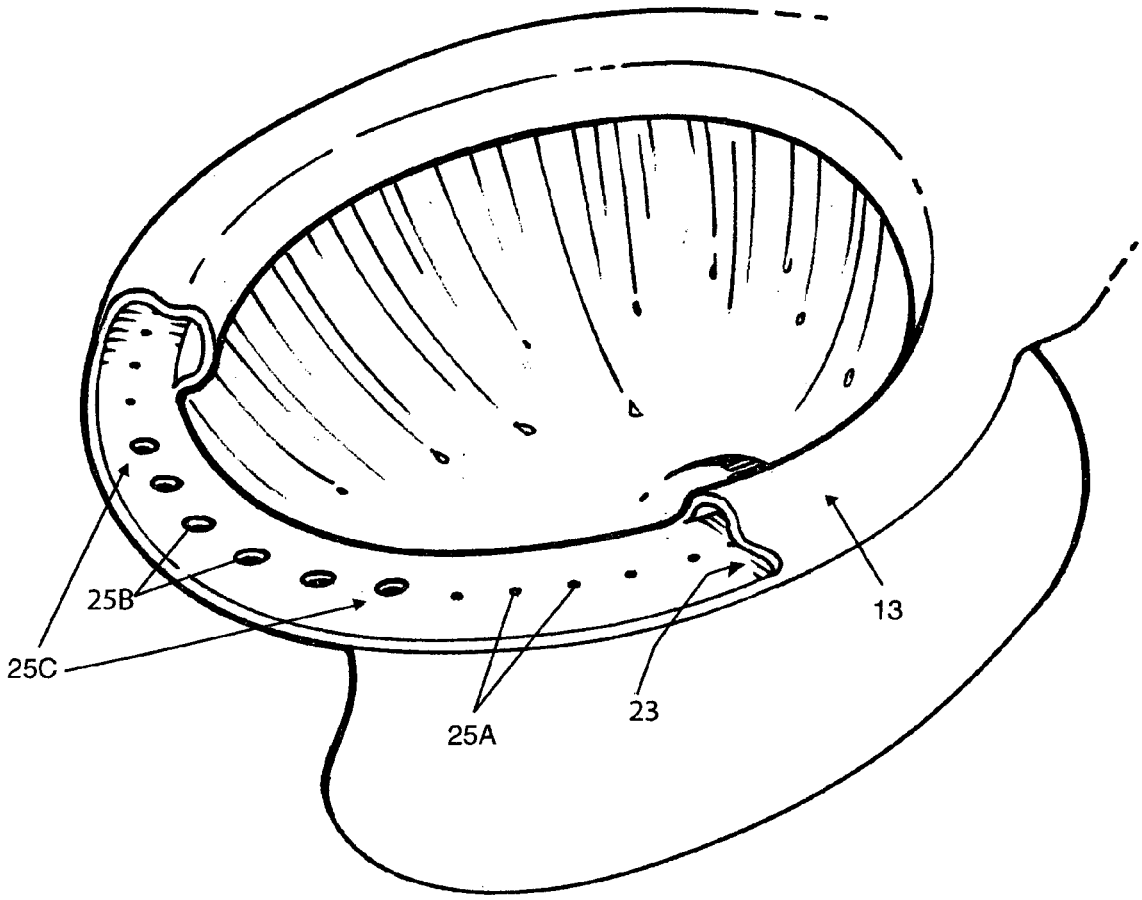
FIG. 2 is an isometric view of a toilet bowl showing part of the upper rim duct.

The bottom portion 13 has a bowl 17. The toilet bowl 17 has a water trap 19 at the bottom, which trap prevents odors from the drain pipe 21 from entering the bowl. Located above the water trap 19 is an air space. The bowl has an upper rim, within which is a duct 23 or conduit (see FIGS. 2 and 3). The bottom of the upper rim duct 23 is perforated with apertures or openings 25A, 25B, 25C. The upper rim duct 23 has openings all around the bowl. Most of the openings 25A are small in diameter, about 3/32 inches. At the front of the bowl are large openings 25B, 25C. In the preferred embodiment, there are four openings 25B 8/10 inches in diameter while between the large openings 25B and the small openings 25A are openings 25C 4/10 inches in diameter. The openings 25B, 25C are greatly enlarged relative to the smaller openings 25A. The larger openings 25B, 25C are at least 15 times larger in area than the smaller openings 25A.

The upper rim duct 23 communicates with an aperture 27 located rearwardly of the bowl 13. The aperture 27 receives water from the water tank 15. A drain channel 31 extends from the bottom of the bowl 17 up and over a lip 33 and then down to the bottom of the toilet. The water trap 19 is located in the drain channel and the bottom of the bowl 17. The drain channel 31 is aligned with the drain pipe 21 in the floor. In the preferred embodiment, water flows into the bowl 17 during flushing only from the openings 25A, 25B, 25C at the upper rim. The toilet, as thus far described, with the openings 25A, 25B, 25C, is conventional and commercially available. I have tried other toilets, with small apertures 25A around the upper rim duct, and no large openings, and have been dissatisfied by the insufficient volume of air flow. The larger openings 25B, 25C, as well as the base member 41 of FIG. 7 and the enlarged vent pipe 29 provide a large passage for the evacuation of air from the bowl.

The water tank 15 bears on a rear portion of the bottom portion 13. The tank 15 has an opening 35 in the bottom, which opening is aligned with the aperture 27 of the bottom portion 13.

Conventional water tanks have a flapper valve assembly located therein. The assembly is designed to completely cover the tank opening 35 (see FIG. 7). The assembly has a flapper valve 36 and an overflow tube 38, which tube extends up in the tank. The top of the overflow tube is located below the upper rim of the tank. When the water in the tank rises too high, it flows into the overflow pipe 38, through the aperture 27 of the bottom portion and into the bowl 17.

Figures 7, 8:
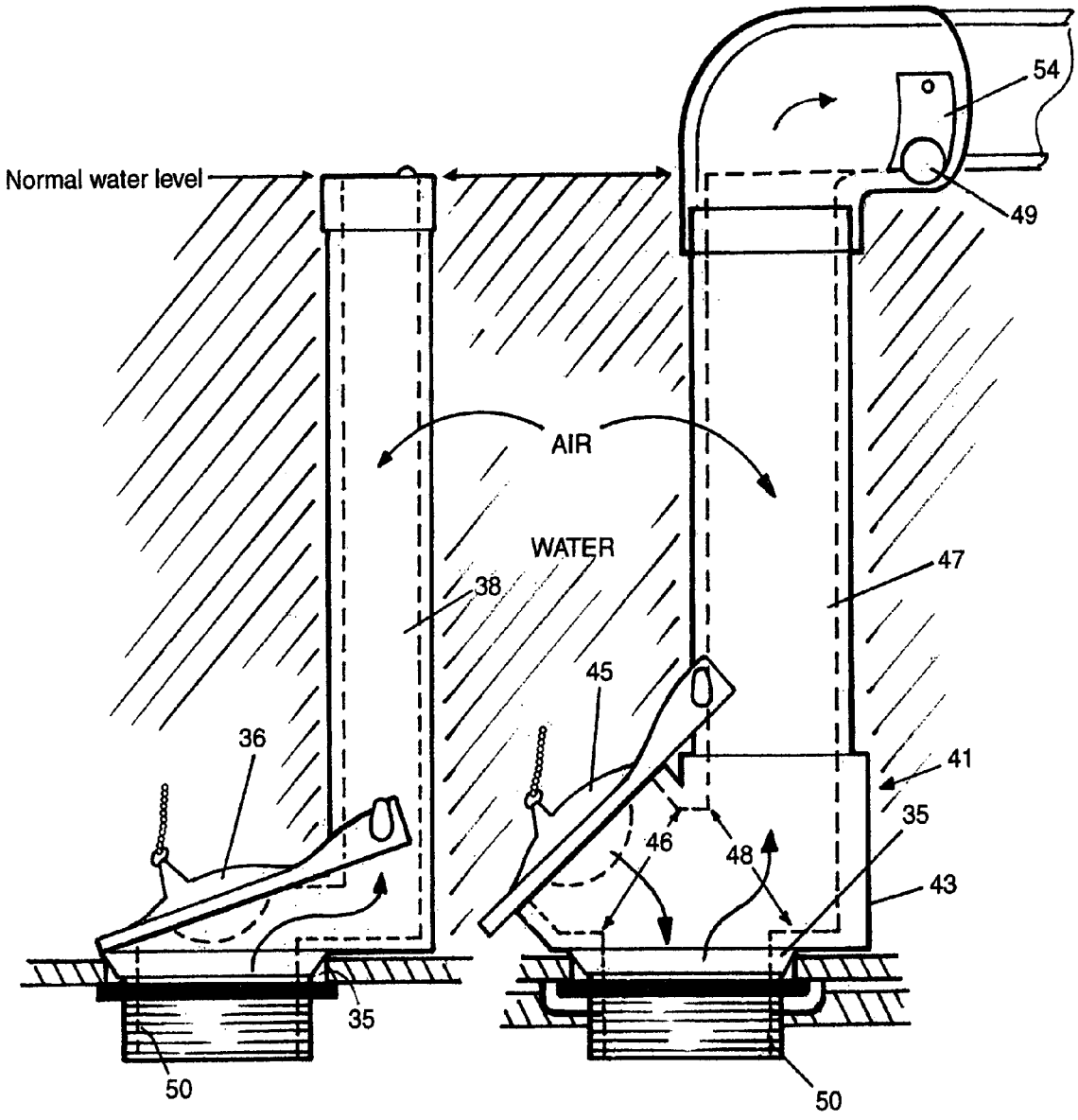
Prior Art Fig. 7
FIG. 7 is a cross-sectional view, as seen from the bowl, of a prior art flapper valve assembly and drain pipe in the tank.
FIG. 8 is a cross-sectional view, as seen from the bowl, of the flapper valve assembly and vent pipe of the present invention, in accordance with a preferred embodiment.

The present invention replaces the conventional flapper valve assembly with a modified flapper valve assembly 41, as shown in FIGS. 1, 3 and 8. The modified assembly 41 has a base member 43 that completely covers the tank opening 35. The flapper valve 45 is located on the base member 43. A vent tube 47 extends up out of the base 43. The base 43 is unlike the base of the prior art flapper valve assembly of FIG. 7. The base member 43 has a flapper valve passage 46 and a vent pipe passage 48 that merge into an aperture 50 which communicates with the aperture 27 and the upper rim duct 23. Both the flapper valve passage 46 and the vent passage 48 are large in diameter so as to allow unobstructed flow of water (through the flapper valve passage) and air (through the vent pipe passage). The inside diameters of the flapper valve passage 46 and the vent pipe passage 48 are at least 70% of the inside diameter of the aperture or opening 50. The base member 43 provides an enlarged vent pipe tube 47 and also repositions the vent tube 47 relative to the tank opening 35. The vent tube 47 is located partially over and in-line with the tank opening. In the preferred embodiment, the vent tube is located about halfway over the tank opening. This arrangement provides a larger and less obstructed passageway flow from the tank opening 35 into the vent tube, thereby providing for increased air flow.

The vent tube 47 exits the water tank 15. The vent tube exit in the water tank is sealed to prevent leakage. The vent tube is provided with a float valve 49. The float valve 49 is located at the maximum water level inside the tank. The valve 49 is normally closed; it opens when the water in the tank is at or near the maximum water level, and thereby allows the excess water to drain into the vent pipe and into the toilet bowl. With the float valve 49, the tank is prevented from overflowing. In the preferred embodiment, the float valve includes an opening in the upper portion of the vent tube. The opening is covered with a flap of rubber 54 (see FIG. 8) or elastomer to provide a seal; the flap is on the outside of the tube and overlays the vent tube opening when the water level in the tank is low and the valve is closed. One side of the flap is connected to the vent tube; the other side can open to uncover the vent tube opening. The unconnected side is coupled to a float. When the water level in the tank rises, the float lifts the flap off of the vent tube opening and allows water to drain.

The vent pipe 47 exits the water tank. Instead of connecting to a pipe in the wall, the vent pipe is routed back to the side of the toilet, at a location that is below, or downstream, of the water trap 19. FIGS. 1A, 4–6 show cross-sectional views of the entry area of the vent pipe into the toilet. The toilet has an entry port 51, which communicates with the drain channel 31 below, or downstream of, the water trap 19. The entry port has a fitting 53 that is permanently mounted therein with cement or some other adhesive. The fitting receives the end of the vent pipe 47.

In the preferred embodiment, the end of the vent pipe 47 has an end piece 61 and an intermediate piece 63. The end piece 61 is a rigid pipe and is inserted into the fitting 53. A stop surface inside of the fitting 53 or the toilet wall 13 is used to position the end piece. A flapper valve 57 is at the end of the end piece 61. When installed, the flapper valve is flush with the wall 13 so as not to impede flow through the drain channel. The flapper valve 57 has a hinge 59 that allows opening and closing. The flapper valve 57 has an inside rubber piece that seals the vent pipe when the valve is closed. A spring 65 maintains the valve 57 normally closed.

The intermediate piece 63 receives the vent pipe 47 in one end. The other end secures to the fitting 53 with conventional latches 67. A seal is provided between the pieces 61, 63. With this arrangement, the end piece 61 can be removed for cleaning (see FIG. 6).

The vent pipe 47 can be rigid or flexible. Alternatively, parts of the vent pipe can be rigid, such as inside the water tank, while other parts are flexible, such as those parts located outside of the water tank.

A fan 55 is located in line with the vent pipe 47. In the preferred embodiment, the fan is electric and is plugged into an electric wall outlet. Other types of fans can be used, such as battery powered fans. The fan is mounted to the side of the toilet, or underneath the tank, and is preferably off of the floor to allow for cleaning of the restroom. The fan is activated by a wall switch adjacent the toilet or by a connection to the same electrical power as the light switch of the restroom. Alternatively, the fan can be actuated automatically when weight is sensed on the toilet seat.

The vent pipe 47 should be of a sufficiently large diameter to draw large volumes of air out of the bowl. In the preferred embodiment, the vent pipe is 1⅝ inches inside diameter PVC pipe. Many toilets have rim duct apertures 25 that are one-eighth inch in diameter. The ordinary toilet has small (⅛ inch) holes on the underside of the rim duct to allow flush water to encircle the bowl. The embodied toilet is of a special type in that all the flush water comes out the holes in the underside of the rim duct. This allows all the flush holes to be used for exhausting the toilet bowel prior to flushing.

The flapper valve is forced open by the exhaust pressure of the fan but closes water tight with the force of the flush and pull of the spring 65. The valve 57 is flush with the inner surface of the toilet wall 13 so as to minimize obstruction of the drain channel and disruption of the siphon caused by flushing. The end of the vent pipe 47 can be removed from the drain channel for cleaning.

In operation, when the fan 55 is turned on, air is withdrawn from the bowl 17, above the water trap 19, through the rim duct apertures 25, the rim ducts 23, bottom portion aperture 27 and the vent pipe 47. Because the vent pipe is enlarged and positioned in-line with the tank aperture 35 (see FIG. 6), larger volumes of air can be exhausted from the bowl. The vent pipe routes the air around the water trap 19 into the drain channel 31. The ventilation system removes air from the bowl and exhausts it to a location downstream of the water trap. Thus, the toilet and the ventilation system is self contained.

During and after flushing, the fan continues to operate so as to exhaust the aerosols caused by flushing from the bowl preventing them from entering the restroom. This is an important factor in preventing the spread of infection by aerosols. The fan can be pressure activated, or a timer can be provided so that once the weight is removed from the seat, the fan continues to operate for some predetermined period of time.

With the present invention, the air passage from bowl 17, around the water trap 19, to the drain channel 31, is sufficiently large so as to move a satisfactory volume of air. Also, the fan 55 need not be so large because the air passage contains little or no restrictions. The provision of the large openings 25B, 25C and the large vent pipe passage 48 in the flapper valve assembly, as well as the large vent pipe, eliminate choke points for air flow.

The foregoing disclosure and showings made in the drawings are merely illustrative of the principles of this invention and are not to be interpreted in a limiting sense.

What is claimed is:

1. A toilet, comprising:

a) a bowl having a drain channel that extends from the bowl, the bowl and the drain channel having a water trap, the bowl having an upper rim;

b) the upper rim having an upper rim duct that communicates with the bowl by plural openings;

c) a water tank located above the bowl, the tank having an aperture that is in communication with the upper rim duct;

d) a base member located in the water tank and covering the aperture, the base member comprising a flapper valve passage and a vent pipe passage, the flapper valve passage is normally covered by a flapper valve that when opened, permits flushing of the bowl through the aperture, the upper rim duct and the openings, the diameter of the vent pipe passage in the base member is 70% of the diameter of the aperture and the diameter of the flapper valve passage in the base member is 70% of the diameter of the aperture, the vent pipe inside diameter is as large as the inside diameter of the vent pipe passage of the base member;

e) a vent pipe extending from and communicating with the vent pipe passage of the base member, out of the water tank, to a location of the drain channel that is downstream of the water trap;

f) a fan in-line with the vent pipe;

g) the upper rim duct being the only channel for conveying water from the water tank to the bowl, with some of the openings in the upper rim duct being larger than the other openings, the larger openings are located at a front portion of the bowl, with the water tank located adjacent a rear portion of the bowl, the larger openings are at least 15 times larger than the other openings;

h) the vent pipe passage and the flapper valve passage both being positioned so as to be partially in line with the aperture, wherein both the vent pipe passage and the flapper valve passage in the base member are unconstricted.

2. The toilet of claim 1 further comprising a one-way valve in the vent pipe so as to prevent gases from downstream of the water trap from entering the bowl by way of the vent pipe.

3. The toilet of claim 2 wherein the one-way valve is a flapper valve located in the drain channel.

4. The toilet of claim 3 wherein the one-way valve is removable for cleaning.

5. A toilet, comprising:

a) a bowl having a drain channel that extends from the bowl, the bowl and the drain channel having a water trap, the drain channel having a wall, the bowl having an upper rim;

b) the upper rim having an upper rim duct that communicates with the bowl by plural openings;

c) a water tank located above the bowl, the tank having an aperture that is in communication with the upper rim duct;

d) a base member located in the water tank and covering the aperture, the base member comprising a flapper valve passage and a vent pipe passage, the flapper valve passage is normally covered by a flapper valve that when opened, permits flushing of the bowl through the aperture, the upper rim ducts and the opening;

e) a vent pipe extending from and communicating with the vent pipe passage of the base member, out of the water tank, the vent pipe having a first end piece;

f) a fan in-line with the vent pipe for removing air within the bowl through the vent pipe;

g) a fitting located in the wall of the drain channel so as to protrude through the wall to the outside of the toilet, the fitting having a channel that communicates with the drain channel at a location that is downstream of the water trap, the fitting is coupled to the first end piece by way of a latch and hook engagement, wherein a person can access the latch and hook engagement from outside the toilet;

h) a second end piece slidably received inside the fitting such that the second end piece is protruding outwardly and extending beyond the fitting for inserting into the first end piece, the second end piece having a one-way valve located therein so as to prevent gases from downstream of the water trap from entering the bowl by way of the vent pipe, the one-way valve exposed to the drain channel and being removable from the fitting for cleaning, the one-way valve comprising a flapper valve that is spring biased by a spring in a normally closed configuration.

* * * * *